US009307316B2

(12) United States Patent
Tu et al.

(10) Patent No.: US 9,307,316 B2
(45) Date of Patent: Apr. 5, 2016

(54) ELECTRONIC DEVICE AND METHOD FOR SENSING HEADSET TYPE BY AUDIO SIGNAL

(71) Applicant: Acer Incorporated, New Taipei (TW)

(72) Inventors: Po-Jen Tu, New Taipei (TW); Jia-Ren Chang, New Taipei (TW); Ming-Chun Yu, New Taipei (TW); Kuei-Ting Tai, New Taipei (TW); Kai-Meng Tzeng, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 143 days.

(21) Appl. No.: 14/163,444

(22) Filed: Jan. 24, 2014

(65) Prior Publication Data

US 2014/0301562 A1 Oct. 9, 2014

(30) Foreign Application Priority Data

Apr. 3, 2013 (TW) ..... 102112173 A

(51) Int. Cl.
*H04R 29/00* (2006.01)
*H04R 3/00* (2006.01)

(52) U.S. Cl.
CPC ..... *H04R 3/00* (2013.01); *H04R 2420/01* (2013.01); *H04R 2420/05* (2013.01); *H04R 2420/09* (2013.01)

(58) Field of Classification Search
CPC ..... H04R 29/00; H04R 29/001
USPC ..... 381/58, 104–109, 74, 77, 79, 56
See application file for complete search history.

(56) References Cited

U.S. PATENT DOCUMENTS 7,187,775 B2 * 3/2007 Fujita ..... H04R 5/04 381/11
9,025,785 B2 * 5/2015 Ohtsuka ..... G03B 31/00 381/122
2013/0320993 A1 * 12/2013 Mehrabi ..... G01R 31/04 324/508

* cited by examiner

*Primary Examiner* — Disler Paul
(74) *Attorney, Agent, or Firm* — Edell, Shapiro & Finnan, LLC

(57) ABSTRACT

In a device including a headset jack having an external microphone contact, and an external microphone signal path connected to the external microphone contact, a method including detecting whether a headset plug is plugged into the headset jack and, if the headset plug is detected, selecting an audio signal received from the external microphone signal path, recording the selected audio signal, to produce a recorded audio signal, and determining if an external microphone is connected to the external microphone contact based on the recorded audio signal.

13 Claims, 7 Drawing Sheets

ELECTRONIC DEVICE AND METHOD FOR SENSING HEADSET TYPE BY AUDIO SIGNAL

CROSS-REFERENCE TO RELATED APPLICATIONS

This application claims priority under 35 U.S.C §119 to Taiwan patent application, TW 102112173, filed on Apr. 3, 2013, the disclosure of which is incorporated herein by reference.

TECHNICAL FIELD

The present disclosure relates generally to an audio-capable electronic device.

BACKGROUND

A consumer electronic device, such as a personal computer, cell phone, and the like, is typically equipped to playback audio through external speakers connected to the device. The device may also be connected to an external microphone to record audio from a user. Typically, the device requires additional circuitry to detect the presence of the external microphone. Such additional circuitry disadvantageously occupies valuable printed circuit board (PCB) real estate in a consumer market that demands that electronic devices be made ever smaller and cheaper.

SUMMARY

According to an embodiment, an electronic device is configured to automatically detect whether an external microphone is connected to the electronic device. The device includes a headset jack and an external microphone contact. The device also includes an external microphone signal path connected to the external microphone contact, and a headset detector to detect whether a headset plug is plugged into the headset jack. An audio processor, connected to the headset detector and the external microphone signal path, is configured to select an audio signal received from the external microphone signal path if the headset detector detects that a headset plug is plugged into the headset jack. The processor module is further configured to record the selected audio signal, to produce a recorded audio signal, and determine if an external microphone is connected to the external microphone contact based on the recorded audio signal.

BRIEF DESCRIPTION OF THE DRAWINGS

Embodiments are described herein in conjunction with the accompanying drawings, in which.

DESCRIPTION OF EXAMPLE EMBODIMENTS

Figure 1:
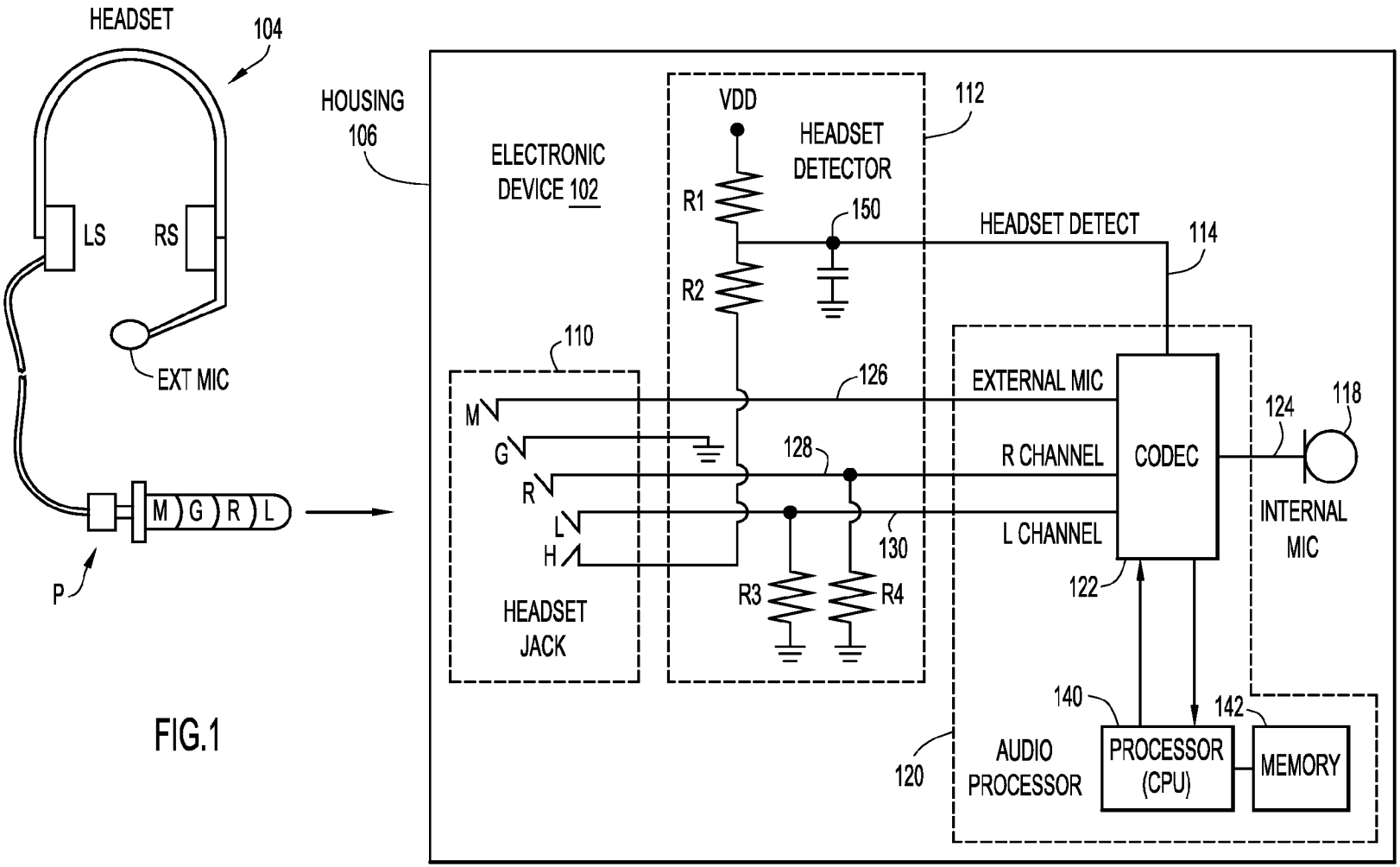
FIG. 1 is a circuit/block diagram of an example audio-capable electronic device configured to detect a connection to an external microphone.

FIG. 1 is a circuit/block diagram of an example audio-capable electronic device 102 configured to automatically detect whether an external microphone is connected to the electronic device and to configure the device accordingly, without the need for additional circuitry. Examples of electronic device 102 include, but are not limited to, any audio-capable device equipped to play and/or receive audio, such as a mobile phone, personal computer, tablet computer, MP3 (MPEG 1 or 2 Audio Layer III) player, and so on. Electronic device 102 may be connected to and operate with external audio equipment, such as external speakers to which electronic device 102 sends audio signals, an external microphone from which the electronic device receives audio signals, or, for example, an audio headset that may or may not combine external speakers with an external microphone.

A headset 104 depicted in FIG. 1 is an example of the external audio equipment to which electronic device 102 may be connected. Headset 104 may be a conventional headset that includes a left speaker LS, a right speaker RS, and an external (EXT) microphone (MIC), each connected to a headset plug P configured to be plugged into electronic device 102. In the arrangement depicted in FIG. 1, headset 104 includes external microphone EXT MIC; however, in other arrangements, the headset may only include speakers, and no microphone. Accordingly, electronic device 102 is configured to (i) detect automatically whether the headset (e.g., headset 104), when plugged into the electronic device, includes an external microphone, and (ii) configure the electronic device to receive/process audio from the external microphone if it is detected, as will be described below.

Electronic device 102 includes a housing 106 to house the following device circuits/modules: an audio jack 110 (simply referred to as a "jack 110") to receive an audio plug (simply referred to as a "plug") from external audio equipment; a headset detector 112 to detect whether the plug is plugged into jack 110 and produce a corresponding headset detect signal 114; an internal microphone 118 to receive audio from an external source, such as a user of electronic device 102; and an audio processor 120 to process audio signals and control electronic device 102 in accordance with techniques described herein.

Audio processor 120 includes an audio signal processor 122, such as a coder/decoder or "codec," a central processor unit (CPU) or "processor" 140, and a memory 142. Memory 142 may comprise a computer readable storage medium encoded with computer executable instructions that, when executed by processor 140, cause the processor to perform operations described herein. Codec 122 receives headset detect signal 114 and processes audio signals based on the headset detect signal, i.e., based on whether the head set detect signal indicates that a plug is plugged into device jack 110. Codec 122 (i) receives an audio signal from internal microphone 118 over an internal microphone path 124, (ii) receives an audio signal over an external audio path 126 that may or may not be connected to an external microphone, and (iii) provides left and right speaker channel audio signals (L CHANNEL and R CHANNEL) to left and right speaker channel signal paths 130 and 128, respectively. Codec 122 may include digital components to process audio signals in a digital domain, i.e., digitized audio signals, audio components to process the audio signals in an analog domain, or a combination thereof, as would be appreciated by one having ordinary skill in the relevant arts.

As mentioned above, headset detector 112 is configured to detect whether a plug, such as headset plug P, is plugged into device jack 110. It is to be understood that headset detector 112 may also detect plugs from other types of external audio equipment, such as external speakers and/or external microphones, which are not necessarily associated with a headset. Thus, the term "headset detector" is to be construed broadly so as to apply to the detection of such other types of external audio equipment. At a high-level, headset detector 112 includes voltage divider circuitry that interacts with jack 110 and plug P to drive headset detect signal 114 to a first voltage (e.g., a relatively high voltage) when plug P is plugged into jack 110 and a second voltage (e.g., a relatively low voltage) when plug P is not plugged into the jack. The first and second voltages respectively indicate to codec 122 the presence and absence of plug P in jack 110. The arrangement of plug P, jack 110, and headset detector 112 depicted in FIG. 1 is now described in detail.

Plug P comprises a substantially cylindrical shaft including electrical contacts M, G, R, and L respectively connected to external microphone EXT MIC, a ground line, right speaker RS, and left speaker LS of headset 104. Plug contacts M, G, R, and L are arranged in series from left-to-right in the order M-G-R-L, as depicted in FIG. 1, and are electrically isolated from each other.

Correspondingly, headset jack 110 comprises a substantially cylindrical receptacle to receive the plug P and that includes electrical pins or contacts M, G, R, and L respectively connected to external microphone path 126, a ground rail, right channel path 128, and left channel path 130 of electronic device 102. Jack contacts M, G, R, and L are arranged in a staggered relationship with respect to each other from left-to-right as depicted in FIG. 1 so as to be aligned and in contact with respective ones of plug P contacts M, G, R, and L when plug P is fully plugged into device jack 110 in the left-to-right direction.

Device jack 110 also incorporates an electrical contact H of headset detector 112 that is aligned with but slightly separated from jack contact L so as to form a normally open circuit with contact L when plug P is not plugged into jack 110. Thus, the headset detection embodiment of depicted in FIG. 1 is referred to as "headset detection with a normally open L speaker channel pin." Jack contact L and contact H are separated from each other such that when plug P is plugged into jack 110, plug contact L bridges, i.e., simultaneously contacts, both jack contact L and contact H, thus forming a closed circuit (i.e., an electrical connection) between jack contact L and contact H. The significance of this arrangement/operation will become apparent from the ensuing description.

Headset detector 112 further includes the following components: a resistor R1 connected between a voltage rail VDD of device 102 and a node 150 that supplies/generates headset detect signal 114; a resistor R2 connected between node 150 and contact H; a resistor R3 connected between left channel speaker path 130 and the ground rail of device 102; a resistor R4 connected between right channel speaker path 128 and the ground rail of device 102.

When plug P is not plugged into jack 110, node 150/headset detect signal 114 is pulled-up to voltage VDD through resistor R1 because contact H is open (i.e., not connected) with respect to jack contact L. The relatively high voltage (VDD) of headset detect signal 114 indicates to codec 122 that plug P is not plugged into jack 110, i.e., that headset 104 is not detected.

On the other hand, when plug P is plugged into jack 110, then jack contact L is electrically connected to contact H by plug contact L to complete a circuit from contact H to the ground rail of device 104 through resistor R3. Thus, node voltage 150/headset detect signal 114 is pulled down from relatively high voltage VDD (in the absence of plug P) to a relatively low voltage equal to VDD×(R2+R3)/(R1+R2+R3). The relatively low voltage of headset detect signal 114 indicates to codec 122 that plug P is plugged into jack 110, i.e., headset 104 is detected.

Figure 2:
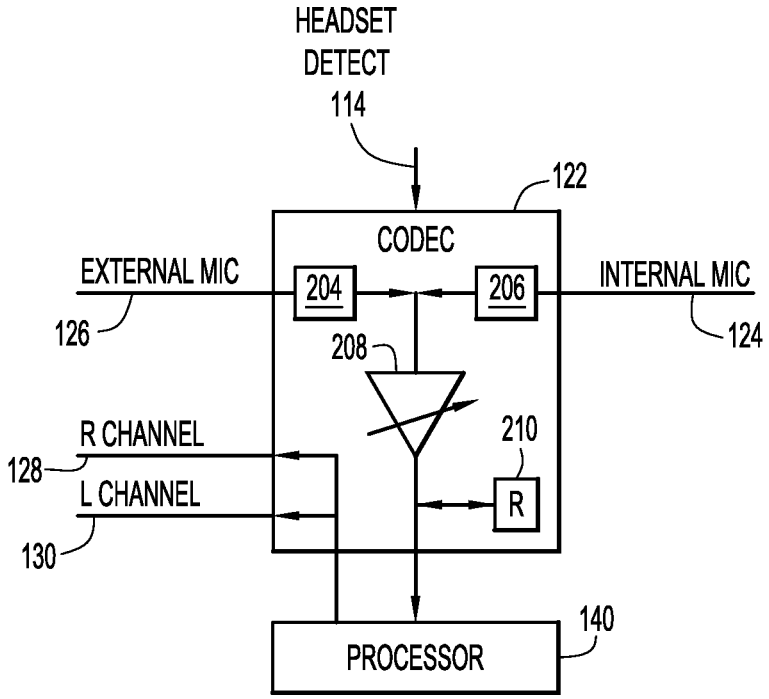
FIG. 2 is a block diagram of a coder/decoder or "codec" of the electronic device of FIG. 1.

FIG. 2 is a block diagram of codec 122, according to an embodiment. Codec 122 includes: a first switch 204 in-line with external microphone path 126; a second switch 206 in-line with internal microphone path 124; a variable gain stage/amplifier 208 to amplify an audio signal provided to an input thereof through a selected one of switches 204, 206, and to produce an amplified audio signal at an output of the amplifier; and an audio record module 210 coupled to the output of the audio amplifier. The above mentioned components of codec 122 may be implemented as digital components to process digitized audio signals in a digital domain, analog components to process analog audio signals in an analog domain, or a combination thereof, as would be appreciated by one having ordinary skill in the relevant arts.

Codec 122 controls switches 204, 206 responsive to headset detect signal 114. Specifically, codec 122 opens and closes switches 204, 206 to connect respective audio paths 126, 124 to, and disconnect the respective audio paths from, the input of variable gain stage 208. In other words, a closed switch (204 or 206) passes an audio signal on the respective audio path (126 or 124) to the input of variable gain stage 208, and the respective path is said to be "enabled." In contrast, an open switch (204 or 206) disconnects an audio signal on the respective audio path (126 or 124) from the input of gain stage 208, and the respective path is said to be "disabled." Codec 122 selectively opens and closes switches 204 and 206 in a mutually exclusive manner so that when external microphone path 126 is enabled (connected), internal microphone path 124 is disabled (disconnected), and vice versa.

Variable gain stage 208 amplifies the audio signal provided to its input by the enabled one of paths 126, 124, and provides the amplified signal to record module 210 and processor 140. Responsive to headset detect signal 114, codec 122 causes record module 210 to record the amplified audio signal output by variable gain stage 208 for a predetermined period of time, to produce a recorded audio signal. Record module 210 provides the recorded audio signal to processor 140. The arrangement of switches 204, 206 and variable gain stage 208 depicted in FIG. 2 is by way of example only; other arrangements are possible, as would be appreciated by those of ordinary skill in the relevant arts with reference to the present description.

Figure 3:
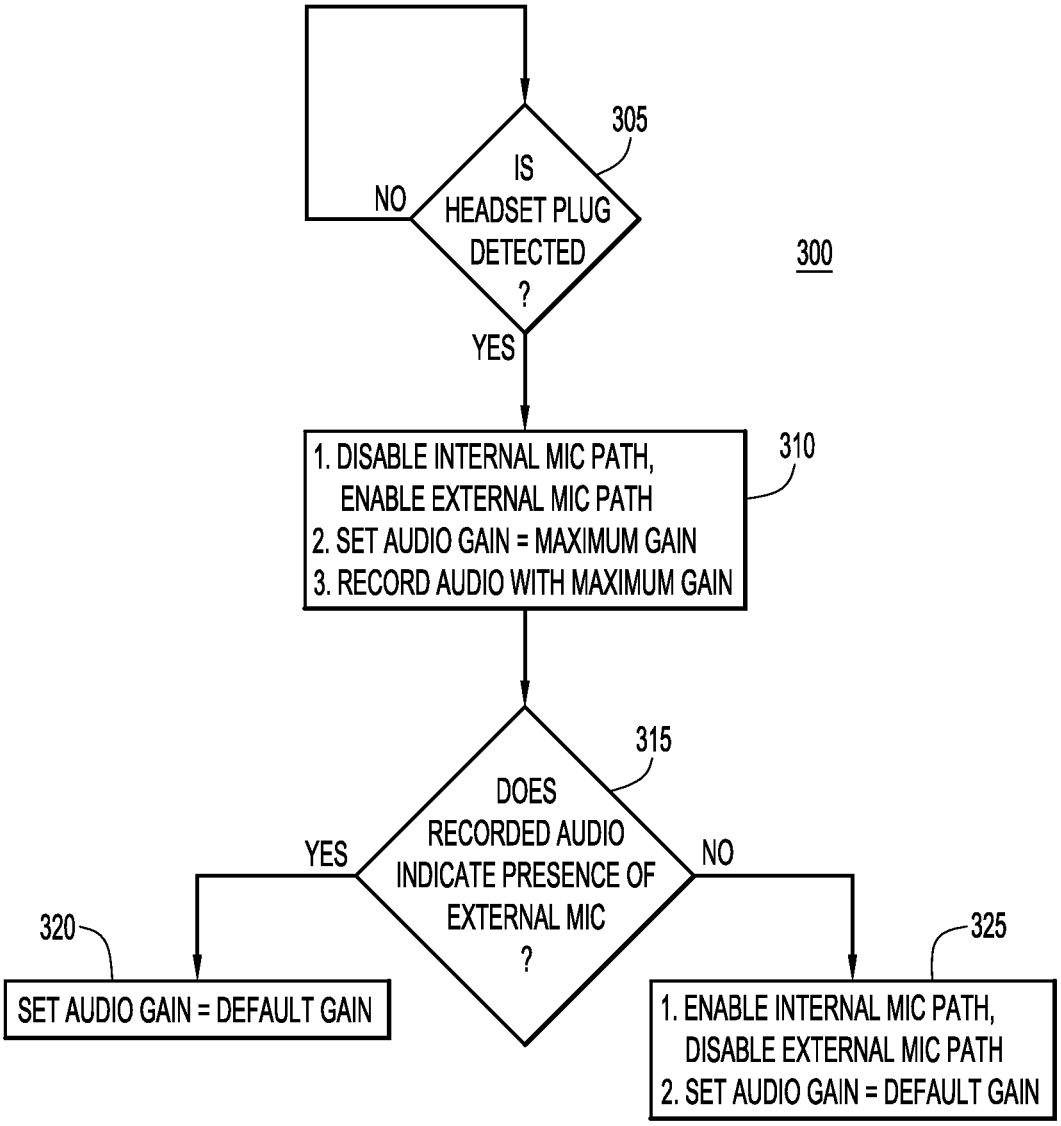
FIG. 3 is a flowchart of an example method of detecting whether an external microphone is connected to the electronic device of FIG. 1.

FIG. 3 is a flowchart of an example method 300 of detecting whether an external microphone is connected to electronic device 102. FIG. 3 is now described also with reference to FIGS. 1 and 2.

Initially, codec 122 enables internal microphone path 124, disables external microphone path 126, sets a gain of variable gain stage 208 to a default gain (e.g., half-way between available minimum and maximum gains of the variable gain stage), and disables record module 210. In this initial configuration, codec 122 amplifies an internal microphone signal from internal microphone path 124 and passes the amplified audio signal to processor 140.

At 305, headset detector 112 detects whether a plug (e.g., plug P) is plugged into jack 110. If not, operation 305 repeats. If a plug is detected, flow proceeds to 310.

At 310, codec 122 disables internal microphone path 124, enables external microphone path 126, increases the gain of variable gain stage 208 from the default to the maximum gain, and enables record module 210 to record the amplified audio signal originating from enabled external microphone path 126 for a predetermined time period, to produce a recorded audio signal. The predetermined time period may be any suitable time period, such as between 1 and 20 milliseconds; however, other time periods are possible. Record module 210 provides the recorded audio signal to processor 140. Codec 122 then disables record module 210 so that the record module does not continue to record audio signals.

Figure 4:
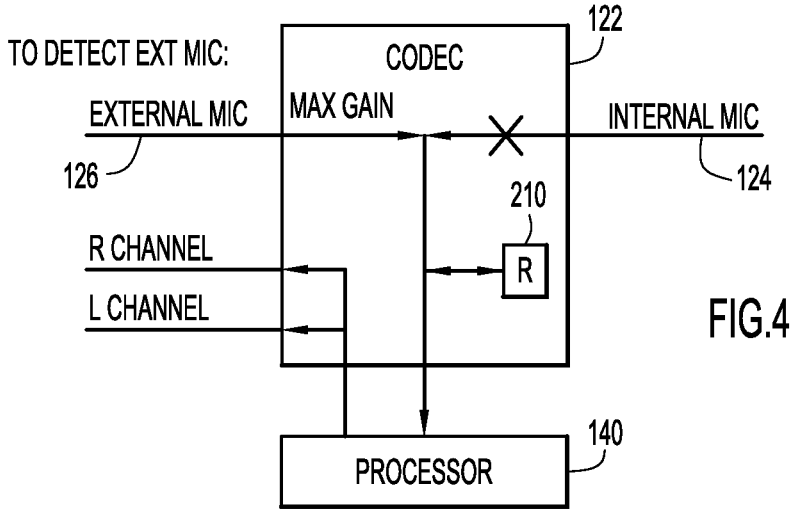
FIGS. 4-6 are illustrations of different switch and gain settings in the codec resulting from different operational stages in the method of FIG. 3.

FIG. 4 is an illustration of switch and gain settings in codec 122 as a result of operation 310. Note that in FIG. 4, variable gain stage 208 is omitted for convenience and is represented as "MAX GAIN," and the label "X" intersecting internal microphone path 124 indicates that path 124 is disabled, i.e., that switch 206 is open, thereby disconnecting internal microphone path 124 from the input of the variable gain stage. With these codec switch settings, external microphone path 126 extends from jack contact M to the input of record module 210.

At 315, processor 140 determines whether an external microphone is connected to jack 110 (contact M) based on the recorded audio signal. Processor 140 communicates its determination, i.e., that an external microphone is connected, or, alternatively, that an external microphone is not connected, to codec 122.

If it is determined at 315 that an external microphone is connected, then flow proceeds to 320.

At 320, codec 122 decreases the gain of variable gain stage 208 from the maximum to the default gain, and normal codec processing continues, i.e., variable gain stage 208 provides the amplified audio signal to processor 140.

Figure 5:
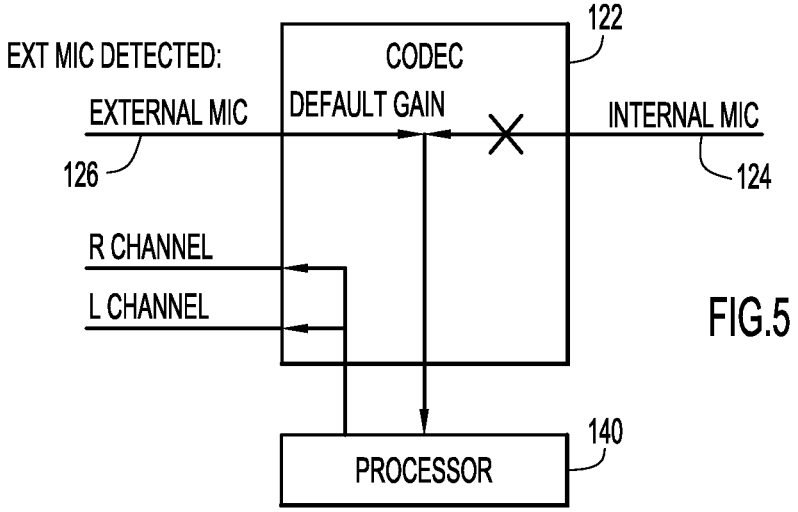

FIG. 5 is an illustration of switch and gain settings in codec 122 as a result of operation 320.

If it is determined at 315 that an external microphone is not connected, then flow proceeds to 325. At 325, codec 122 disables external microphone path 126, enables internal microphone path 124, and decreases the gain of variable gain stage 208 from the maximum gain to the default gain, and normal codec processing continues.

Figure 6:
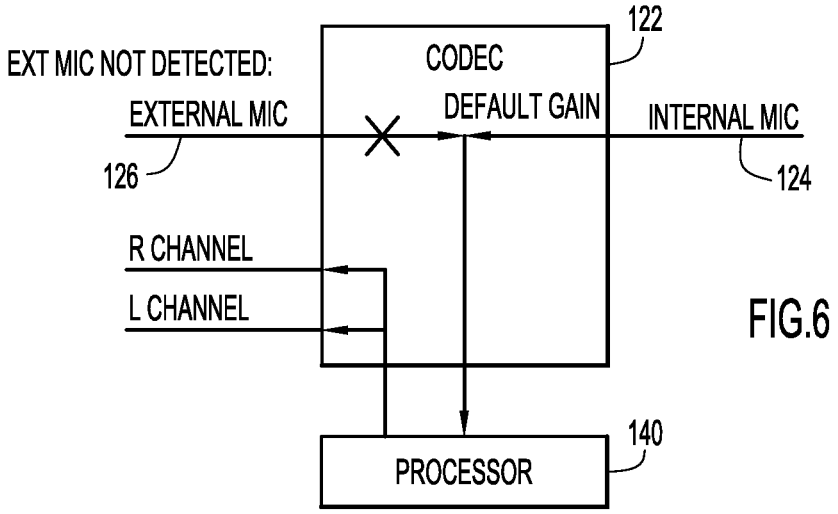

FIG. 6 is an illustration of switch and gain settings in codec 122 as a result of operation 325.

Figure 7:
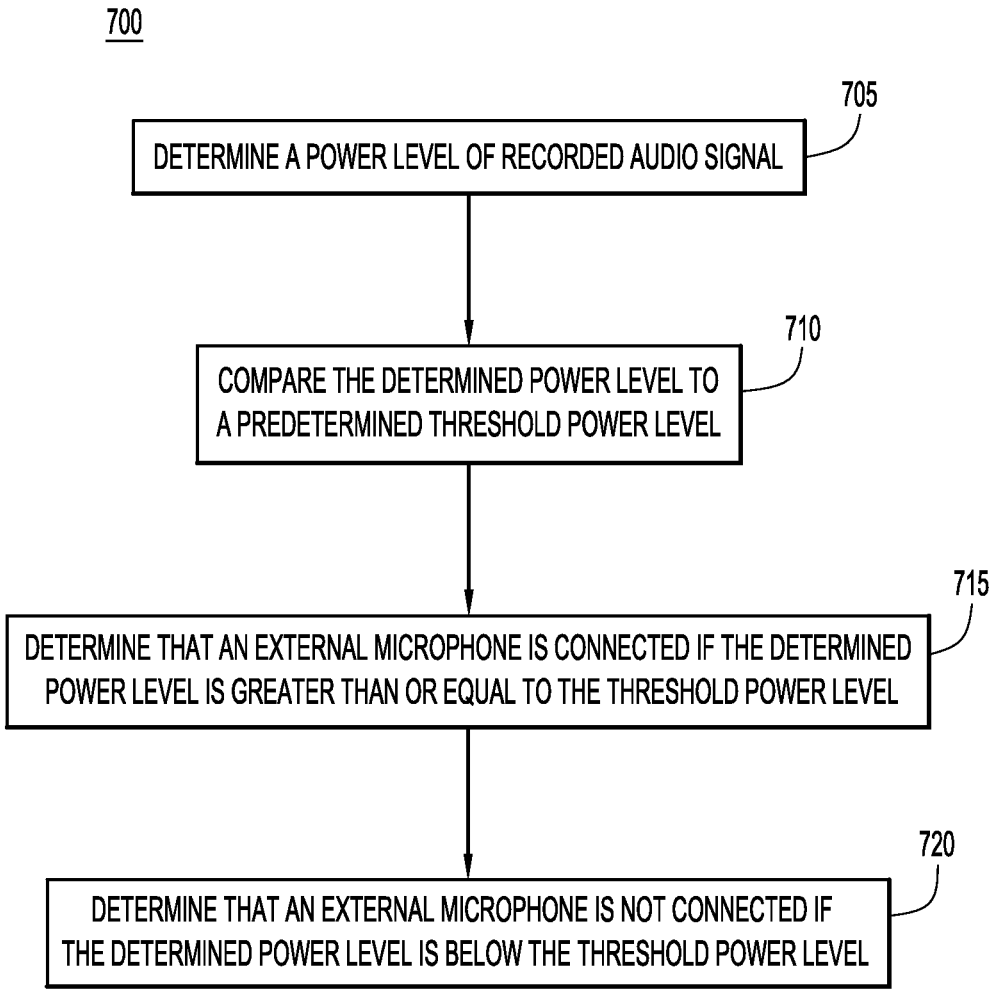
FIG. 7 is a flowchart of an example method expanding on an operation in the method of FIG. 3 to determine whether an external microphone is detected based on a recorded audio signal.

FIG. 7 is a flowchart of an example method 700 expanding on operation 315 to determine whether an external microphone is detected based on the recorded audio signal.

At 705, processor 140 determines at least one metric related to the recorded audio signal, such as a power level (e.g., an average power level), a maximum amplitude, or a combination thereof. At 710, processor 140 compares the determined metric (e.g., power level) to predetermined threshold (e.g., threshold power level).

At 715, processor 140 determines that an external microphone is connected if the determined metric is equal to or greater than the predetermined threshold.

At 720, processor 140 determines that an external microphone is not connected if the determined metric is below the threshold.

The predetermined threshold used in method 700 is set to distinguish between the recorded audio produced when an external microphone drives external microphone path 126 and the recorded audio produced in the absence of the external microphone. In the absence of the external microphone, the recorded audio captures/represents only amplified quiescent circuit noise coupled onto external microphone path 126. On the other hand, when an external microphone is connected to external microphone path 126, the microphone drives an audio signal onto the path, and the recorded audio represents/captures an amplified version of that audio signal. An amplitude/power level of the amplified quiescent circuit noise is substantially less than an amplitude/power level of the amplified audio from the external microphone. In an embodiment, the predetermined threshold used in method 700, which may be determined empirically, is set above the expected amplitude/power level of the amplified quiescent circuit noise and below or equal to the expected amplitude/power level of the amplified audio signal from the external microphone.

From the above description, it can be seen that electronic device 102 advantageously uses existing circuit components, e.g., codec 122 and processor 140, to detect whether an external microphone is connected to the electronic device and to configure the device accordingly. Therefore, no additional circuitry and corresponding circuit board space is required to perform these operations.

Figure 8:
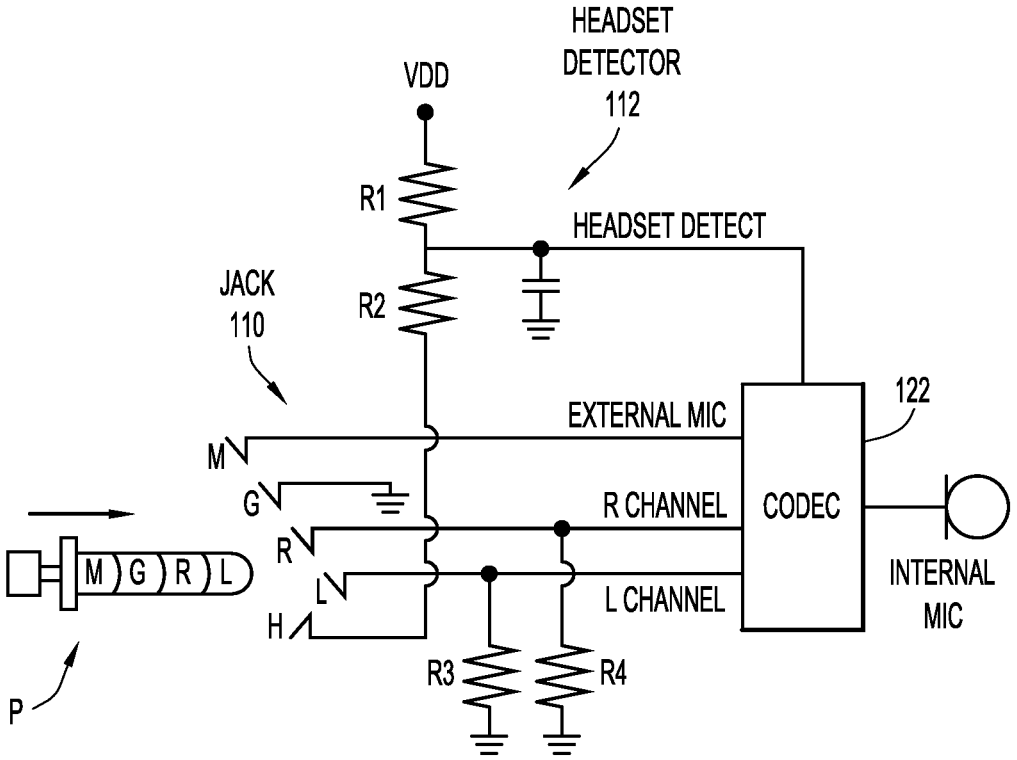
FIGS. 8-10 are circuit diagrams of different headset detector embodiments.
Figure 9:
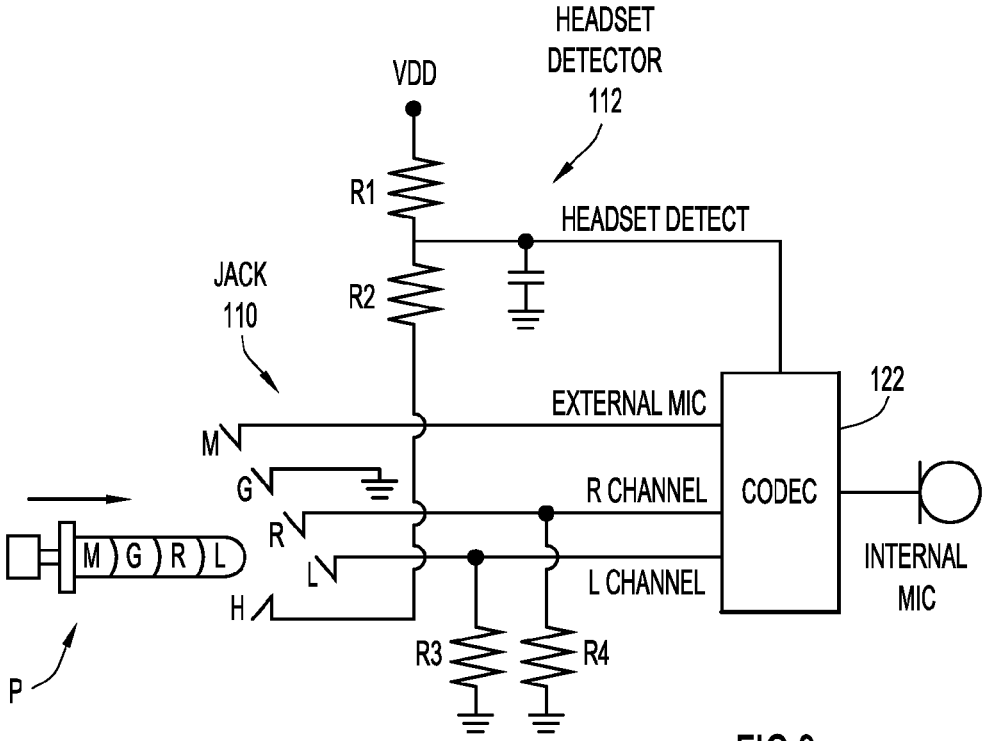
Figure 10:
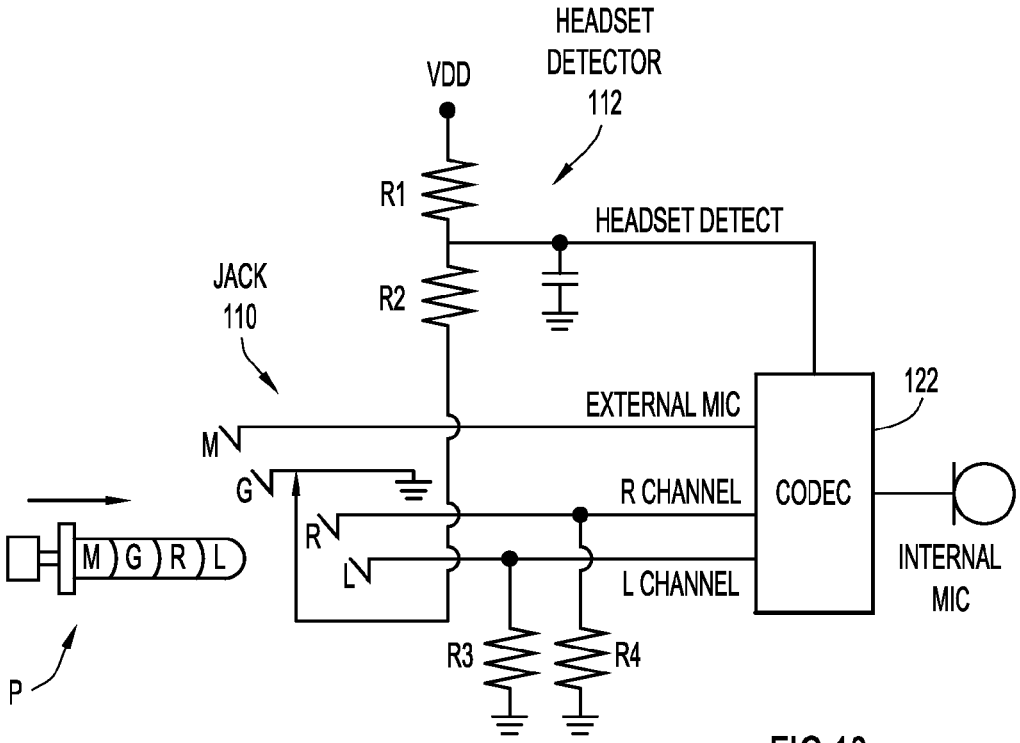

FIGS. 8, 9, and 10 are circuit diagrams of different headset detector embodiments.

FIG. 8 is a circuit diagram of the headset detector that achieves headset detection using a normally open R speaker channel pin/contact. The embodiment of FIG. 8 is substantially the same as that of FIG. 1, except that headset detector pin H is aligned with and separated from jack contact R, instead of jack contact L as in FIG. 1. As depicted in FIG. 8, contact H and jack contact R form a normally open circuit with respect to each other when plug P is not plugged into jack 110, but they form a closed circuit when plug P is plugged into jack 110, in which case plug contact R bridges contact H and jack contact R. Accordingly, when plug P is plugged into device jack 110, then jack contact R electrically connects contact H to the ground rail of device 102 through resistor R4. Thus, node voltage 150/headset detect signal 114 is pulled down from relatively high voltage VDD (in the absence of plug P) to a relatively low voltage.

FIG. 9 is a circuit diagram of the headset detector that achieves headset detection using a normally open ground pin/contact. The embodiment of FIG. 9 is substantially the same as that of FIGS. 1 and 8, except that contact H is aligned with and separated from jack contact G, which is connected directly to the ground rail of electronic device 102. When plug P is plugged into jack 110, plug contact G connects contact H to jack contact G, to pull-down headset detector signal 114 from VDD to a relatively low voltage.

FIG. 10 is a circuit diagram of the headset detector that achieves headset detection using a normally closed ground pin/contact. As depicted in FIG. 10, a lower end of resistor R2 is normally connected to jack ground contact G when plug P is not plugged into jack 110, so that headset detect signal 114 is normally pulled-down to a relatively low voltage through resistor R2. When plug P is plugged into jack 110, the plug disconnects resistor R2 from jack contact G, and thus headset detect signal 114 becomes pulled-up to VDD though resistor R1.

The above description is intended by way of example only.

What is claimed is:

1. A method, comprising:

in a device including a jack having an external microphone contact, and an external microphone signal path connected to the external microphone contact:

detecting whether a plug is plugged into the jack; and if the plug is detected:

selecting an audio signal received from the external microphone signal path;

recording the selected audio signal, to produce a recorded audio signal; and determining if an external microphone is connected to the external microphone contact based on the recorded audio signal, wherein the determining includes:

determining a power level of the recorded audio signal;

determining that an external microphone is connected if the power level is greater than or equal to a predetermined threshold; and determining that an external microphone is not connected if the power level is below the predetermined threshold.

2. The method of claim 1, wherein the device further includes an internal microphone and an internal microphone signal path connected to the internal microphone, the method further comprising:

if the plug is detected and if it is determined that an external microphone is not connected based on the recorded audio signal, selecting an audio signal received from the internal microphone signal path.

3. The method of claim 1, further comprising:

if the plug is detected, before the recording, increasing an audio gain of the external microphone signal path from a first gain up to a second gain; and if it is determined that the external microphone is connected based on the recorded audio signal, decreasing the gain from the second gain down to the first gain.

4. The method of claim 3, wherein the device further includes an internal microphone and an internal microphone signal path connected to the internal microphone, the method further comprising:

if the plug is detected and if it is determined that the external microphone is not connected based on the recorded audio signal, selecting an audio signal received from the internal microphone signal path; and decreasing the gain from the second gain down to the first gain.

5. The method of claim 3, wherein the first gain is a default gain and the second gain is a maximum gain.

6. An apparatus, comprising:

a jack including an external microphone contact;

an external microphone signal path connected to the external microphone contact;

a detector to detect whether a plug is plugged into the jack; and an audio processor, connected to the detector and the external microphone signal path, configured to:

select an audio signal received from the external microphone signal path if the detector detects that a plug is plugged into the jack;

record the selected audio signal, to produce a recorded audio signal; and determine if an external microphone is connected to the external microphone contact based on the recorded audio signal, wherein the audio processor is configured to determine by:

determining a power level of the recorded audio signal;

determining that an external microphone is connected if the power level is greater than or equal to a predetermined threshold; and determining that an external microphone is not connected if the power level is below the predetermined threshold.

7. The apparatus of claim 6, further comprising an internal microphone and an internal microphone signal path connected thereto and to the audio processor, wherein the audio processor is further configured to select an audio signal received from the internal microphone signal path if the plug is detected and if it is determined that an external microphone is not connected based on the recorded audio signal.

8. The apparatus of claim 6, wherein the audio processor is further configured to:

if the plug is detected, before the selected audio signal is recorded, increase an audio gain of the external microphone signal path from a first gain to a second gain; and if it is determined that the external microphone is connected based on the recorded audio signal, decrease the gain from the second gain to the first gain.

9. The apparatus of claim 8, further comprising an internal microphone and an internal microphone signal path connected thereto and to the audio processor, wherein the audio processor is further configured to:

select an audio signal received from the internal microphone signal path if the plug is detected and if it is determined that the external microphone is not connected based on the recorded audio signal; and decrease the gain from the second gain down to the first gain.

10. The apparatus of claim 8, wherein the first gain is a default gain and the second gain is a maximum gain.

11. The apparatus of claim 6, wherein the audio processor includes:

a codec configured to perform the operations to select and record; and a processor configured to perform the operation to determine.

12. The apparatus of claim 6, wherein the jack further includes a speaker contact connected to the audio processor, and wherein the detector includes a circuit configured to detect whether a speaker contact of the plug is in electrical contact with the jack speaker contact.

13. The apparatus of claim 6, wherein the jack further includes a grounded contact, and wherein the detector includes a circuit configured to detect whether a ground contact of the plug is in electrical contact with the jack grounded contact.

* * * * *